US007191553B2

(12) United States Patent
Doucette et al.

(10) Patent No.: US 7,191,553 B2
(45) Date of Patent: Mar. 20, 2007

(54) DITCH DIGGING BUCKET

(75) Inventors: Rene Doucette, Penticton (CA); Guy Doucette, Peachland (CA); Paul Doucette, Peachland (CA); Greg Doucette, Peachland (CA)

(73) Assignee: 0728862 B.C. Ltd., Peachland (CA)

( * ) Notice: Subject to any disclaimer, the term of this patent is extended or adjusted under 35 U.S.C. 154(b) by 99 days.

(21) Appl. No.: 11/044,587

(22) Filed: Jan. 28, 2005

(65) Prior Publication Data

US 2005/0178030 A1 Aug. 18, 2005

Related U.S. Application Data

(60) Provisional application No. 60/539,969, filed on Jan. 30, 2004.

(51) Int. Cl.
*E02F 3/40* (2006.01)

(52) U.S. Cl. ..... 37/444; 37/411; 37/379

(58) Field of Classification Search ..... 37/444, 37/411, 443, 379; 414/694
See application file for complete search history.

(56) References Cited

U.S. PATENT DOCUMENTS

| | | | | |
|---|---|---|---|---|
| 293,261 | A | | 2/1884 | Matcham |
| 1,077,486 | A | | 11/1913 | McKee |
| 1,107,252 | A | | 8/1914 | Black |
| 1,545,942 | A | | 7/1925 | Conlin |
| 1,638,099 | A | | 8/1927 | Rorabeck |
| 1,717,907 | A | | 6/1929 | Andersen |
| 2,018,628 | A | | 10/1935 | Bager |
| 2,416,409 | A | | 2/1947 | Schield |
| 2,972,425 | A | | 2/1961 | Anderson et al. |
| D207,258 | S | | 3/1967 | Leijon |
| 3,702,509 | A | | 11/1972 | Zowaski |
| 3,958,347 | A | * | 5/1976 | Heitman ..... 37/379 |
| 4,037,337 | A | * | 7/1977 | Hemphill ..... 37/444 |
| 4,314,789 | A | | 2/1982 | Luigi |
| 4,704,811 | A | | 11/1987 | Jefferson |
| 4,896,444 | A | | 1/1990 | Sieber et al. |
| 4,903,418 | A | | 2/1990 | Loudon |
| 5,353,531 | A | | 10/1994 | Doucette |
| 5,526,591 | A | | 6/1996 | Otwell |
| 5,909,961 | A | | 6/1999 | Pullman |
| 5,992,062 | A | | 11/1999 | Evans et al. |

* cited by examiner

*Primary Examiner*—Victor Batson
(74) *Attorney, Agent, or Firm*—Antony C. Edwards

(57) ABSTRACT

A one-pass bucket for digging a ditch by moving the bucket with its curved end down longitudinally of the proposed ditch, wherein the bucket includes a top wall, a bottom wall, a rear wall and a side wall diverging forwardly from the rear wall to an open front end of the bucket, the side wall being planar and defining a sharp acutely-angled corner with the bottom wall, the curved end wall, opposite the first side wall, extends convexly from the bottom wall to said top end at a forward edge thereof, and extending substantially diagonally upwardly therefrom at a rearward edge so that the forward edge of the curved end wall curves upwardly towards the plane of the top wall so as to intersect it non-tangentially and the rearward edge extends diagonally to intersect the plane of the top wall whereby a round bottom ditch is formed by rotating said curved end wall downwardly relative to the acutely angled corner and dragging the curved end wall through the soil longitudinally of the proposed ditch in a single pass.

8 Claims, 14 Drawing Sheets

DITCH DIGGING BUCKET

CROSS REFERENCE TO RELATED APPLICATIONS

This application claims priority from U.S. Provisional Patent Application No. 60/539,969 filed Jan. 30, 2004 entitled Ditch Digging Bucket.

FIELD OF THE INVENTION

This invention relates to an improved bucket for use on a mechanical digging apparatus, such as an excavator, having an articulatable boom on the end of which may be mounted a conventional bucket.

BACKGROUND OF THE INVENTION

When a road is cut in the side of a hill or mountain, drainage ditches are usually required to carry away water flowing down the hill or mountain towards the road. Such ditches usually have a V-shaped cross-sectional configuration which tends to concentrate water into a small area of the ditch increasing the likelihood of erosion. With a view to reducing or preventing erosion, it is preferable that the bottom of drainage ditches be round so that the flow of water is spread over a greater area, without under-cutting the embankmnent.

Round bottom ditches have conventionally been cut using excavators, backhoes or other mechanical digging machines having extensible or articulated booms to the distal ends of which are mounted buckets of known type. The machine is parked on the shoulder of a road, the boom and bucket is extended toward the proposed ditch area, the bucket is dropped or forced downwardly into the soil and curled inwardly and the boom is simultaneously retracted. The process is repealed two or three times. During the first pass or passes, the soil is disrupted. The number of such passes required to loosen the soil is dictated by a number of factors including the nature or rockiness of the soil, its compaction, the angle of attack of the edge of the bucket engaging the soil, the available power of the machine which may be applied downwardly on the bucket, and so on. The last pass or passes serve to scoop and clear the loosened soil. Completion of the passes may be considered as a cycle. In the case of conventional square sided buckets, with each cycle a ditch segment the width of the bucket is completed. Conventional square sided buckets are approximately five feet wide, and accordingly each cycle produces approximately five feet of ditch. At the usual speeds, a round bottomed ditch can be produced at a rate of approximately 50 lineal meters per hour.

The conventional ditch digging method described above with respect to square sided buckets suffers from the disadvantage that the simultaneous curl and retraction of the boom and bucket must be controlled accurately which may be difficult for an inexperienced operator. If the curl and retraction are not accurately controlled, the ditch may be over-cut resulting in undermining and premature ditch erosion. Moreover, in order to cut a ditch using the conventional method, the body of the digging apparatus must be swung out into the roadway which results in a hazard to traffic passing on the roadway. Additionally, after each cycle the machine must be moved along the road so as to present the bucket parallel to the road for the next adjacent five foot segment.

It was consequently an improvement in the art of digging ditches to introduce the apparatus which formed the subject of U.S. Pat. No. 5,353,531, which issued to Doucette on Oct. 11, 1994 for an invention entitled Ditch Digging Apparatus and Method. That patent disclosed and claimed the use of a so-called "two-pass" bucket having a square lower corner at one end of the bucket and a curved lower corner at the opposite end of the bucket. When used on a Gradall™-type machine, that is a machine able to rotate the bucket one hundred eighty degrees about the longitudinal axis of its telescopic boom, the square corner was used to loosen the soil on a first pass and the round corner to scoop a round bottom ditch on the second pass. In particular that invention related to a bucket for use on a mechanical ditch digging apparatus where the bucket included top wall means; bottom wall means; rear wall means extending between the top wall means and the bottom wall means; first side wall means extending forwardly from one end of the rear wall means and interconnecting one end of the top wall means and one end of the bottom wall means; and second side wall means extending forwardly from the other end of rear wall means and interconnecting the other end of the top wall means and the other end of the bottom wall means. The top wall means, bottom wall means and side wall means were disclosed as having front edges defining an open front end for receiving earth; the first side wall means defining a square corner with the one end of the bottom wall means, whereby the bracket could be dragged through the earth with the angular corner extending downwardly to form an angular ditch; and the second side wall means defined a convex corner at the other end of the bottom wall means. Thus, when the bucket was rotated one hundred eighty degrees around a longitudinal axis generally parallel to the boom and extending between the side walls, the convex corner extended downwardly for dragging through the angular ditch to form a round bottom ditch.

BRIEF DESCRIPTION OF THE DRAWINGS

What follows below is with reference to the drawings, wherein similar characters of reference denote corresponding parts in each view.

SUMMARY OF THE INVENTION

Figure 1:
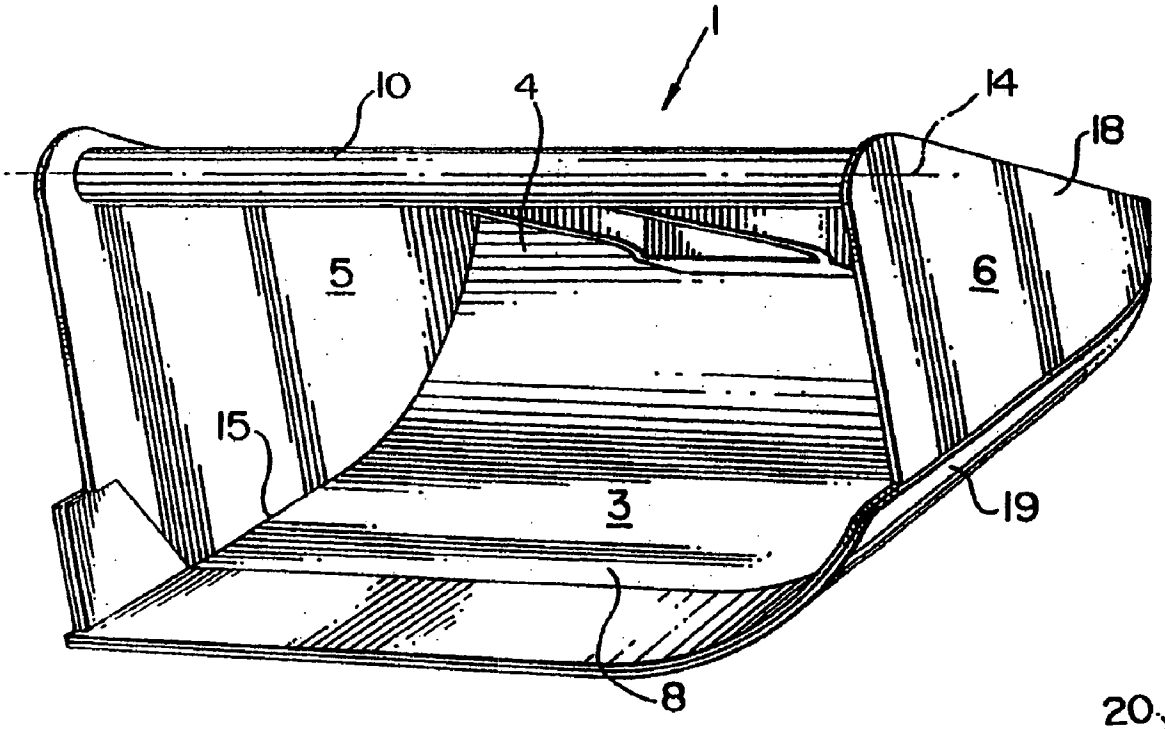
FIG. 1 is, in perspective view, a prior art ditch digging bucket.

In summary, the bucket of the present invention may be characterized as a one-pass bucket (30) for use on the end of an actuable arm on a mechanical ditch digging apparatus for digging a ditch parallel to a roadway; the bucket comprising a top wall (32); a bottom wall (40); a rear wall (34,38) integral with the bottom wall, the rear wall and the bottom wall defining a curve (a') extending downwardly and forwardly from a rear edge (32*a*) of the top wall to an open front end of the bucket; a first side wall (36) extending forwardly from a first end (38*b*) of the rear wall and interconnecting a first end of the top wall (32*b*) and a corresponding first end (40*a*) of the bottom wall; and, a curved end wall (42) opposite the first side wall (36), the curved end wall (42) extending forwardly from an opposite second end (38*c*) of the rear wall, opposite the first end of the rear wall, and interconnecting an opposite second end (32*c*) of the top wall, opposite the first end of the top wall, and an opposite second end (40*b*) of the bottom wall, opposite the first end of the bottom wall, the curved end wall having opposite curved bottom (46*a*) and top (46*b*) ends, the first side wall diverging forwardly (angle δ) from the rear wall; the top wall, the bottom wall and the first side wall having forward edges (32*d*, 40*a*, 36*b*) defining an open front end (30*a*) of the bucket for receiving earth; the first side wall defining an acutely-angular corner (angle θ') with the first end of the bottom wall, whereby the bucket may be dragged through the earth with the acutely-angular corner (angle θ') extending downwardly to break-up particularly densely compacted soil and rock material, the curved end wall defining a convexity (42*a*) extending tangentially from the second end (40*b*) of the bottom wall, the convexity (42*a*) tapering rearwardly toward the rear wall (34, 38), and when viewed in front elevation the curved end wall (42) extending convexly from the bottom wall (40) to the top end (46*b*) at a forward edge (46) thereof, and extending substantially diagonally upwardly therefrom at a rearward edge (44) so that the forward edge (46) of the curved end wall (42) curves upwardly towards the plane of the top wall (32) so as to intersect it non-tangentially, for example generally orthogonally, and the rearward edge (44) extends diagonally (angle α) to intersect the plane of the top wall (32), whereby a round bottom ditch is formed by rotating the curved end wall (42) downwardly relative to the acutely angled corner (angle θ') and dragging the curved end wall (42) through the soil longitudinally of the proposed ditch, often in a single pass, wherein, when the front opening of the bucket is viewed in front elevation (FIG. 4), the bottom wall (40), the rear wall (34, 38), the first side wall (36), and the first end of the top wall (32*b*) define a first portion of the bucket having a first longitudinal axis (C) substantially parallel to and substantially equi-distant between the top and bottom walls; and, the curved end wall (42) and the second end (32*c*) of the top wall define a second portion of the bucket having a second longitudinal axis (D), and wherein the first and second longitudinal axes (C, D) intersect substantially on the rearward edge (44) of the curved end wall (42), and wherein the second longitudinal axis (D) diverges downwardly (angle Δ) from colinearity with the first longitudinal axis (C), and wherein the curved bottom end (46*a*) of the curved end wall (42) intersects the bottom wall (40) generally half-way (ratio f/k) along a length (k) corresponding to generally the length of the top wall (32), and wherein, when the bucket is viewed from a plan view (FIG. 5), the curved end wall (42) diverges forwardly from the rear wall (34, 38) at an angle (angle p) greater than the angle (angle δ) at which the first side wall (36) diverges forwardly from the rear wall (34, 38), and the forward edges of the bottom wall (40) and the curved bottom end (46*a*) of the curved end wall (42) extend forwardly (distance u) of the forward edge (32*d*) of the top wall (32), and the forward edge (46) of the curved end wall (42) slopes rearwardly (angle β), and downwardly (angle π') when viewed in side elevation view (FIG. 6), from. intersecting the forward edge of the bottom wall (40), at the curved bottom end (46*a*), to the top end (46*b*) so that the forward edge of the top end (46*b*) of the curved end wall (42) cuts back and down to intersect the forward edge of the top wall (32), and wherein the curved end wall (42), including a longitudinal outermost tip (46') of the curved end wall (42), extends longitudinally (collinear with axis C) beyond a corresponding end (32*c*) of the top wall (32).

DETAILED DESCRIPTION OF EMBODIMENTS OF THE INVENTION

Figure 3:
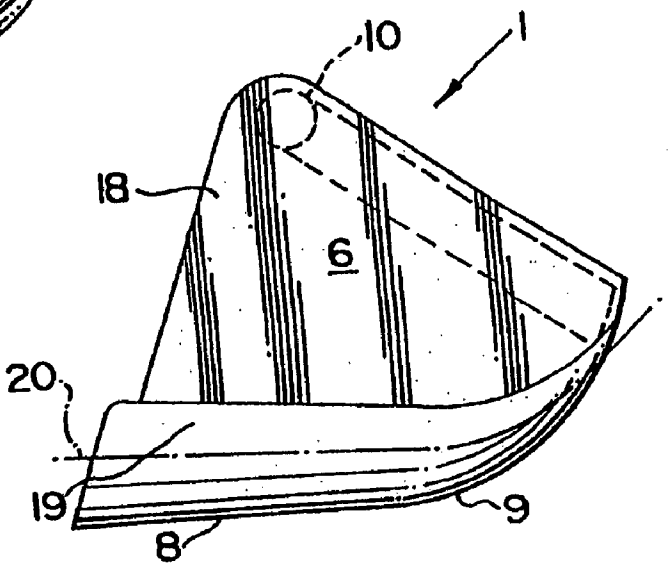
FIG. 3 PRIOR ART
FIG. 3 is the prior art bucket of FIG. 1 in right side elevation view.
Figure 2:
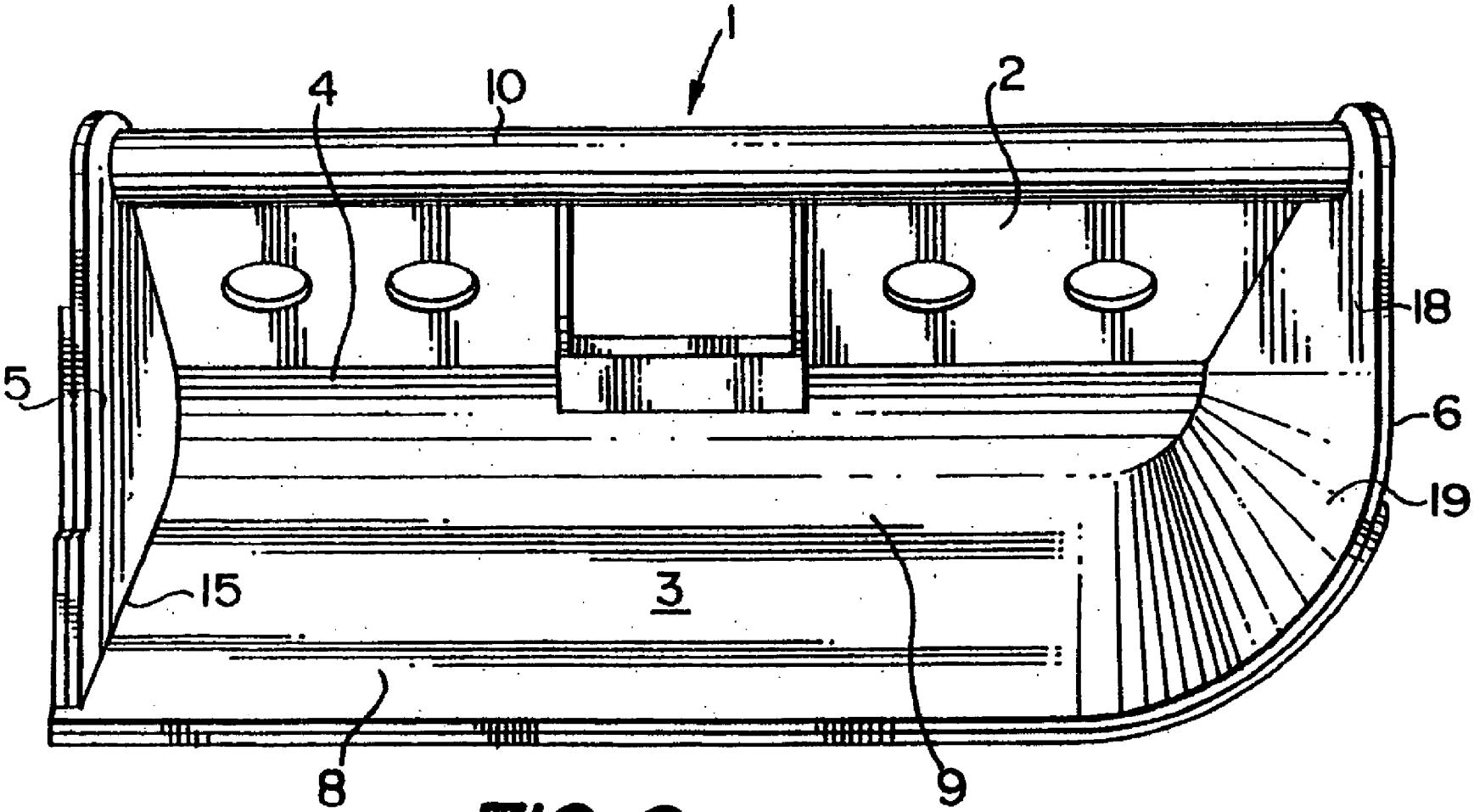
FIG. 2 PRIOR ART
FIG. 2 is the prior art bucket of FIG. 1 in front elevation view.

In the prior art as taught in U.S. Pat. No. 5,353,531 to Doucette, and as illustrated in FIGS. 1–3 herein taken from the corresponding Figures in the Doucette reference, it is known to provide a ditch digging bucket generally indicated at 1 which includes a top wall 2, a bottom wall 3, a rear wall 4, and a pair of side walls 5 and 6. The top wall 2, the bottom wall 3 and the side walls 5 and 6 extend forwardly from the rear wall 4, and the free front edges thereof define an open front end or mouth. The rear wall 4 is integral with the bottom wall 3, the two walls curving downwardly and forwardly from the straight, planar top wall 2 of the bucket. The bottom wall 3 includes a reinforced, flat, planar portion 8 at the open front end of the bucket and an arcuate rear portion 9 flowing smoothly into the arcuate rear wall 4. A crossbar 10 extends across the front end of the top wall 2 between the side walls 5 and 6 for connecting the bucket to a ditch digging vehicle or apparatus disclosed by Doucette to be a Gradall™-type excavating machine which includes an extensible boom which can be rotated around its own longitudinal axis. The side wall 5 is flat and planar, and defines an angle of ninety degrees with each of the top wall 2 and the bottom wall 3. Thus, there is a square corner 15 formed at the bucket opening between the side wall 5 and the bottom wall 3 which is used to cut a generally V-shaped or angular ditch in the ground when the bucket 1 is dragged through the soil with the corner 15 extending downwardly.

The other side wall 6 includes a flat, planar portion 18 adjacent cross-bar 10 and a curved portion 19. There is an angle of ninety degrees between the flat portion 18 and the top wall 2. The curved portion 19, which is convex extends outwardly from the rear wall 4 between the flat portion 18 of the side wall 6 and the bottom wall 3 defining a convex arc or corner on the exterior of the bucket. At the mouth of bucket, the front, free edge of the curved portion 19 extends through an arc of ninety degrees. The curved portion 19 tapers rearwardly from the mouth of the bucket to the rear wall 4. The longitudinal axis 20 of the curved portion 19 follows the contour of the upwardly curving bottom wall 3 of the bucket. The side wall 6, like the side wall 5, defines an angle with the rear wall 5 in excess of ninety degrees to prevent skidding of the outer surface of the side wall 6 over the soil when the bucket is in the downward cutting position. The angle between the side wall 6 and the rear wall 4 is greater than the angle between the side wall 5 and the rear wall 4.

In operation the vehicle to which prior art bucket 1 is mounted is positioned on one side of a roadway so that the axles of the vehicle are perpendicular to the longitudinal axis of the roadway. In this position, the boom of the vehicle can be extended at an angle to the longitudinal axis of the roadway with only a small portion of the vehicle extending into the roadway. The boom is fully extended and the bucket 1 is rotated so that the angular corner 15 extends downwardly towards the soil. The boom is actuated to push the bucket 1 downwardly into the soil, and the boom is retracted to cut a V-shaped ditch. Once the V-shaped ditch has been cut, the bucket 1 is removed from the soil and the boom is fully extended. The bucket 1 is rotated through one hundred eighty degrees, so that the curved portion 19 of the side wall 6 extends downwardly. The distal end of the boom is lowered so that the flat portion 18 of the, side wall 6 is parallel to and adjacent one side of the ditch. In this position, the other side of the ditch is in the path of the bucket 1 and the curved portion 19 of the side 6 is positioned to cut a round bottom in the ditch. The boom is retracted to cut an approximately twelve feet long round bottom ditch, that is to clear away a portion of the side of the ditch and to form the round bottom in the ditch. Thus, with the vehicle in position, a length of round bottom ditch is produced with two passes of the bucket 1 over and through the soil; namely a first pass to cut a length of V-shaped ditch and the second pass to scoop-out and form a length of round bottom ditch generally coinciding with the span of the boom. The two passes constitute one cycle in the formation of the length of ditch, and thus one length of ditch is formed upon completion of each cycle. The length of ditch formed during each cycle is determined by the amount by which the boom can be retracted, which for Gradall units is determined by the telescopic length of the boom, usually twelve feet. Therefore the completion of each cycle produces approximately twelve feet of ditch, taught to result in doubling the digging rate the rate of 100 lineal meters/hour.

Figure 4:
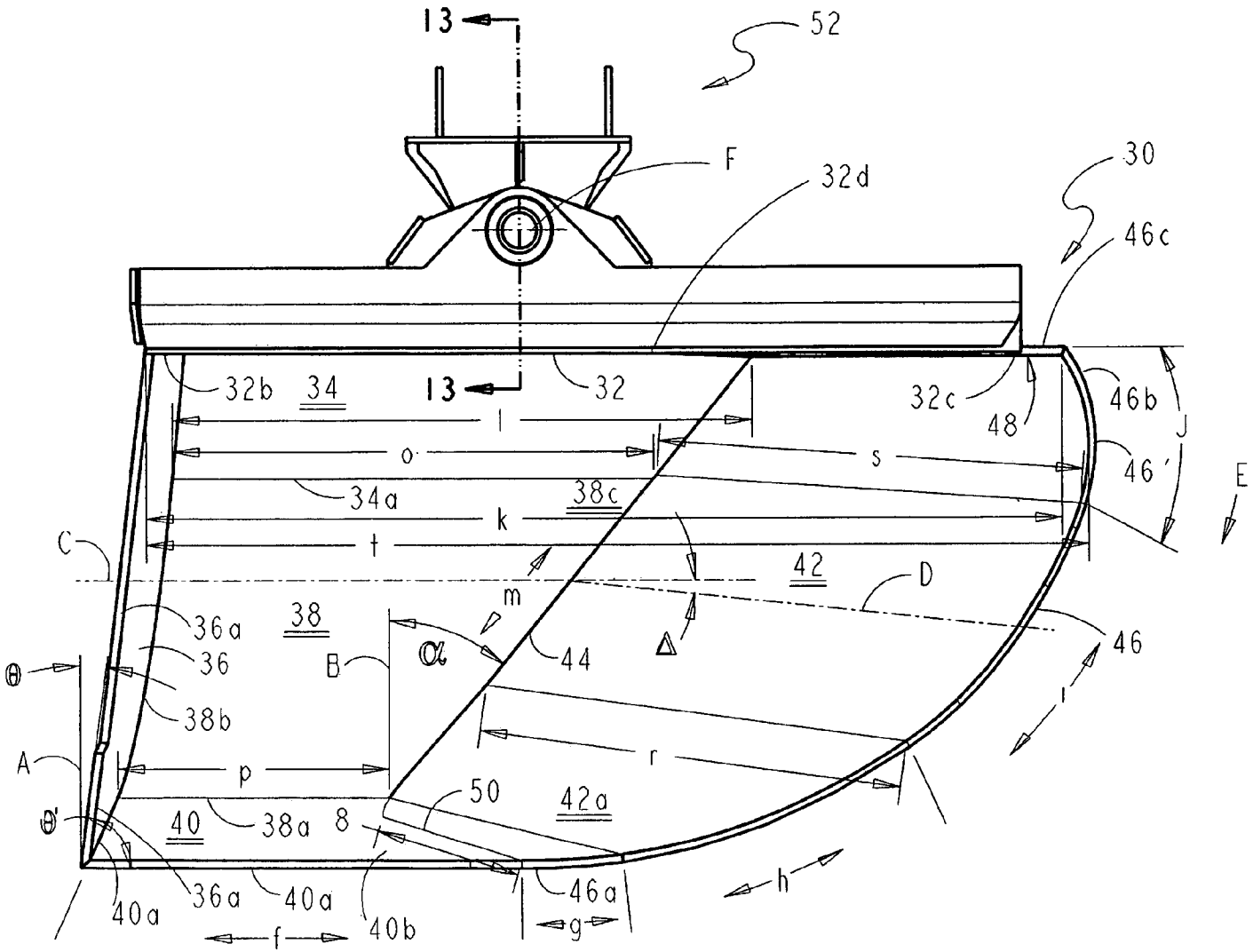
FIG. 4 is, in front elevation view, the ditch digging bucket according to one embodiment of the present invention.

The present invention is an improvement over the prior art in that the bucket provides for digging a round bottom ditch often with only a single pass so as to increase or even double the rate of ditch excavation to for example 200 lineal meters per hour, and advantageously when used in conjunction with a conventional excavator as an attachment pivotally mounted on the distal end of the stick. Thus as seen in FIG. 4, one-pass bucket 30 has a planar top wall 32, a planar rear wall 34, a left side planar wall 36, a curved lower wall 38, a generally planar bottom wall 40, and a curved end wall 42. Left side planar wall 36 is not orthogonal to bottom wall 40 but rather forms an angle θ relative to a plane A which is orthogonal to bottom wall 40 and intersects the seam between left side wall 36 and top wall 32. Rear wall 34 is bounded on three sides by linear seams formed between rear wall 34 and top wall 32, left side wall 36, and lower wall 38 respectively. Rear wall 34 and lower wall 38 may also be formed of a unitary piece, and lower wall 38 and bottom wall 40 may also be formed of a unitary piece so long as in side elevation view they generally or substantially form the curvature of the bucket as illustrated by way of example in FIG. 6. Lower wall 38 is bounded on three sides by rear wall 34, left side wall 36, and bottom wall 40. The fourth and right sides of rear wall 34, lower wall 38, and bottom wall 40 are bounded by the left hand and bottom edge of curved end wall 42 respectively.

In particular, the left edge 44 of curved end wall 42 is generally diagonally upwardly inclined when viewed in front elevation and forms an angle α between left edge 44 and a plane B orthogonal to rear wall 34, lower wall 38, and bottom wall 40. The right edge 46 of curved end wall 42, that is the edge opposite from left edge 44, forms, when viewed in front elevation, a complex curve which at its lower end **46*a* is generally tangent to bottom wall 40 and at its upper end 46*b* completes the scalloped or scooped lip of curved end wall 42 as it intersects non-tangentially for example generally orthogonally, with the top wall 32. Curved end wall 42, although illustrated as formed of six contiguously seamed segments, is not intended to be so limited in its various embodiments. That is, curved end wall 42** may be formed of one continuous curved sheet having no flat spots or may be segmented by a plurality of curved or planar plate segments welded together along their adjacent seams so as to form one contiguous generally curved sheet member having flat spots.

Top wall 32, rear wall 34, lower wall 38, bottom wall 40, and left side wall 36 may be characterized as forming a first bucket portion having a longitudinal axis C which extends parallel and generally equidistant between top wall 32 and bottom wall 40. Curved end 42 may be characterized as forming a second bucket portion having its own longitudinal axis D which extends perpendicularly, when viewed in front elevation, from left edge 44 at the intersection with longitudinal axis C so as to form the angle Δ therebetween and so as to extend generally parallel between the upper and lower edges 48 and 50 respectively of curved end wall 42. As may be seen perhaps best in FIG. 4, longitudinal axes C and D of, the first and second portions of bucket 30 so defined are not collinear respectively, but rather, the second portion of the bucket formed by curved end wall 42 forms a shovel or scoop having a principle axis declined or diverging or otherwise dropped downwardly relative to the first portion of the bucket. Thus, with a bucket coupler 52 such as Twist-A-Wrist™ pivotable coupler mounted to the distal end of an excavator stick 54 as better seen in FIGS. 10 and 11, bucket 30 may be rotated in direction E about the pivot axis F of coupler 52 so as to rotate curved end wall 42 downwardly relative to stick 54 while simultaneously rotating the first portion of the bucket upwardly. Thus rotation about axis F forms a first degree of freedom for rotational movement of bucket 30. Of course, a second degree of freedom is provided by the conventional scooping motion of the bucket toward the cab of the excavator about axis G. Other degrees of freedom of motion are provided by the extension and retraction and swiveling of stick 54 and boom 56 relative to the base 58 of the excavator and by translation of the excavator on its tracks forwardly or rearwardly as for example parallel to roadway 60 while translating the excavator along shoulder 62.

Figure 5:
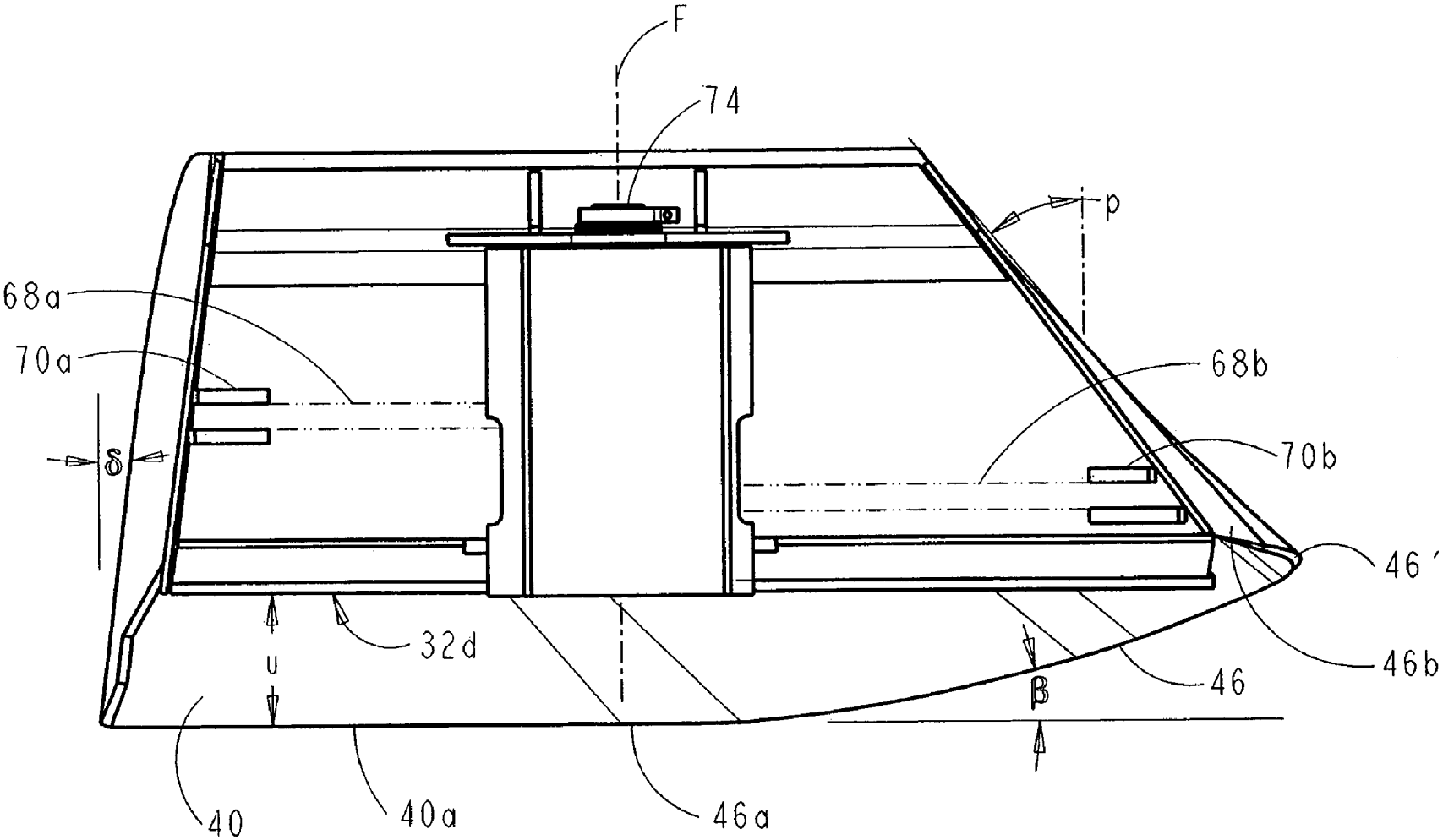
FIG. 5 is, in plan view, the bucket of FIG. 4.
Figure 6:
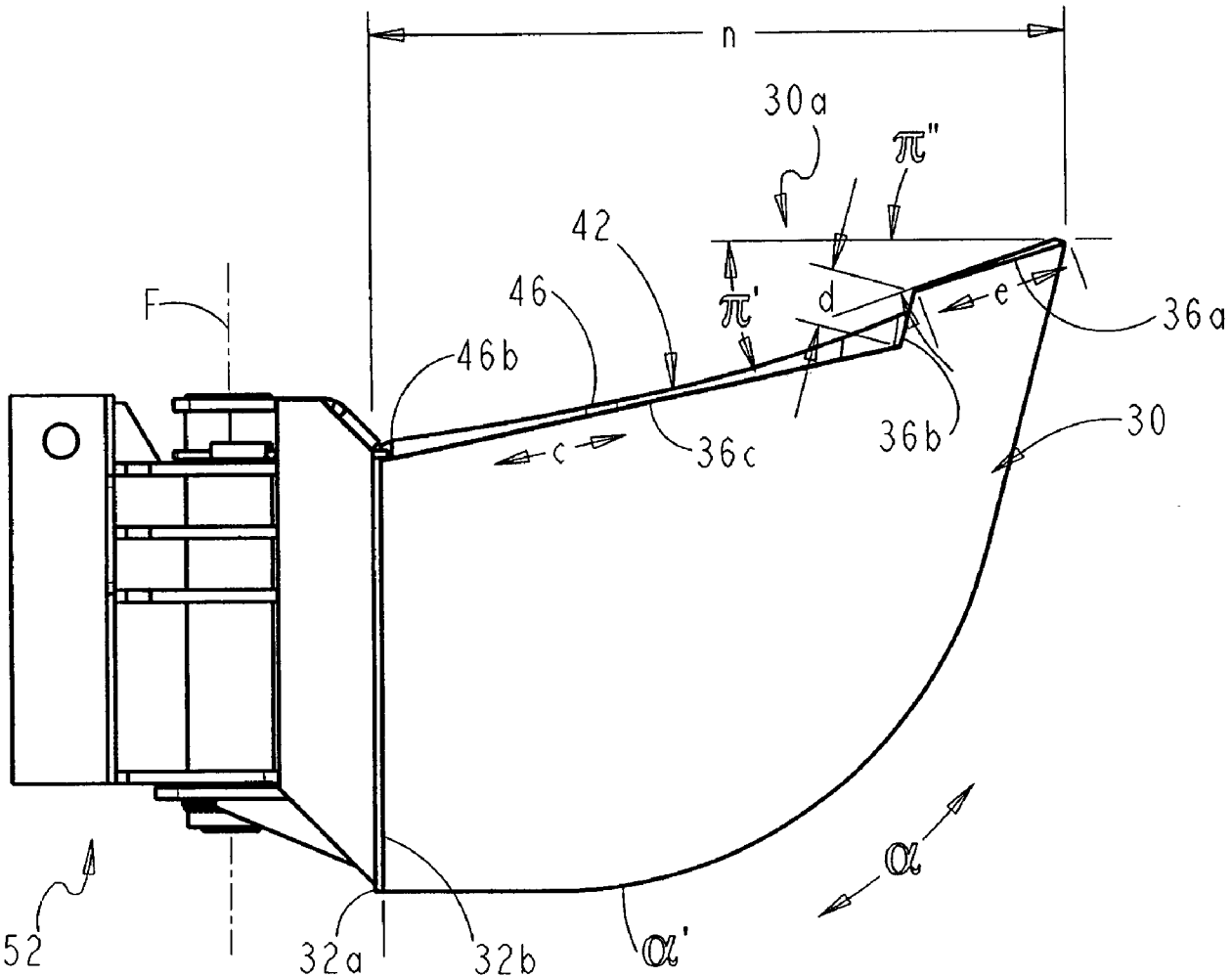
FIG. 6 is, in left side elevation view, the bucket of FIG. 4.
Figure 7:
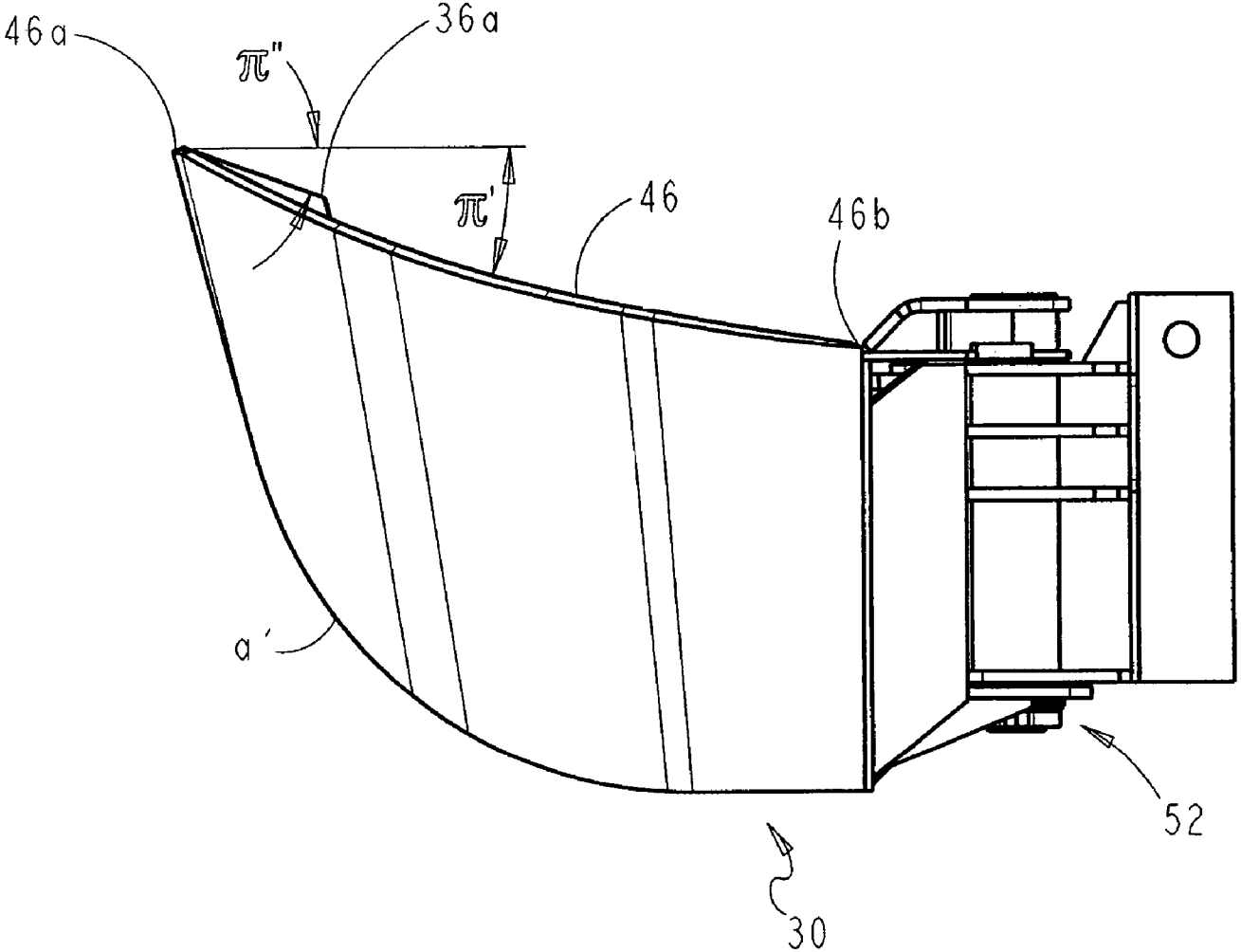
FIG. 7 is, in right side elevation view, the bucket of FIG. 4.
Figure 8:
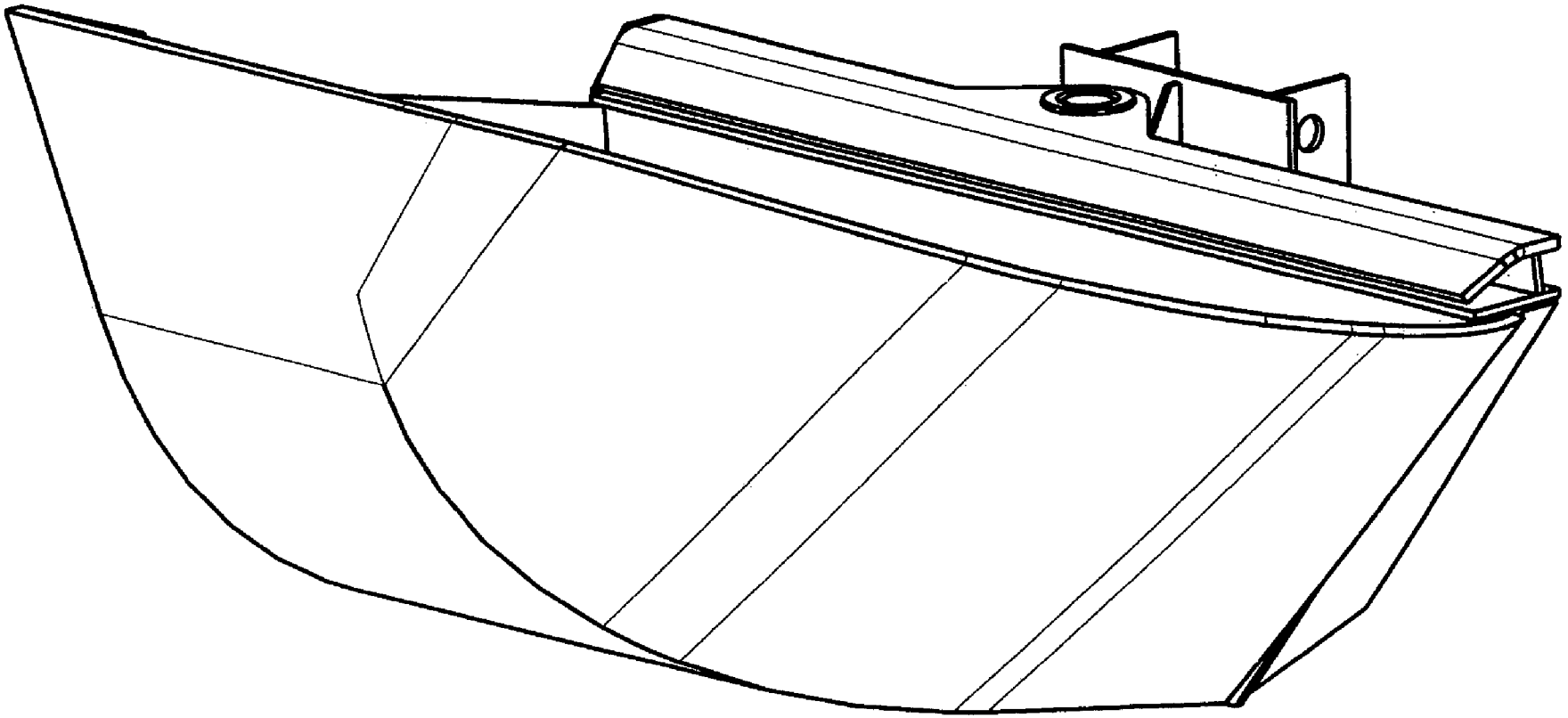
FIG. 8 is, in right side perspective view, the bucket of FIG. 4.
Figure 9:
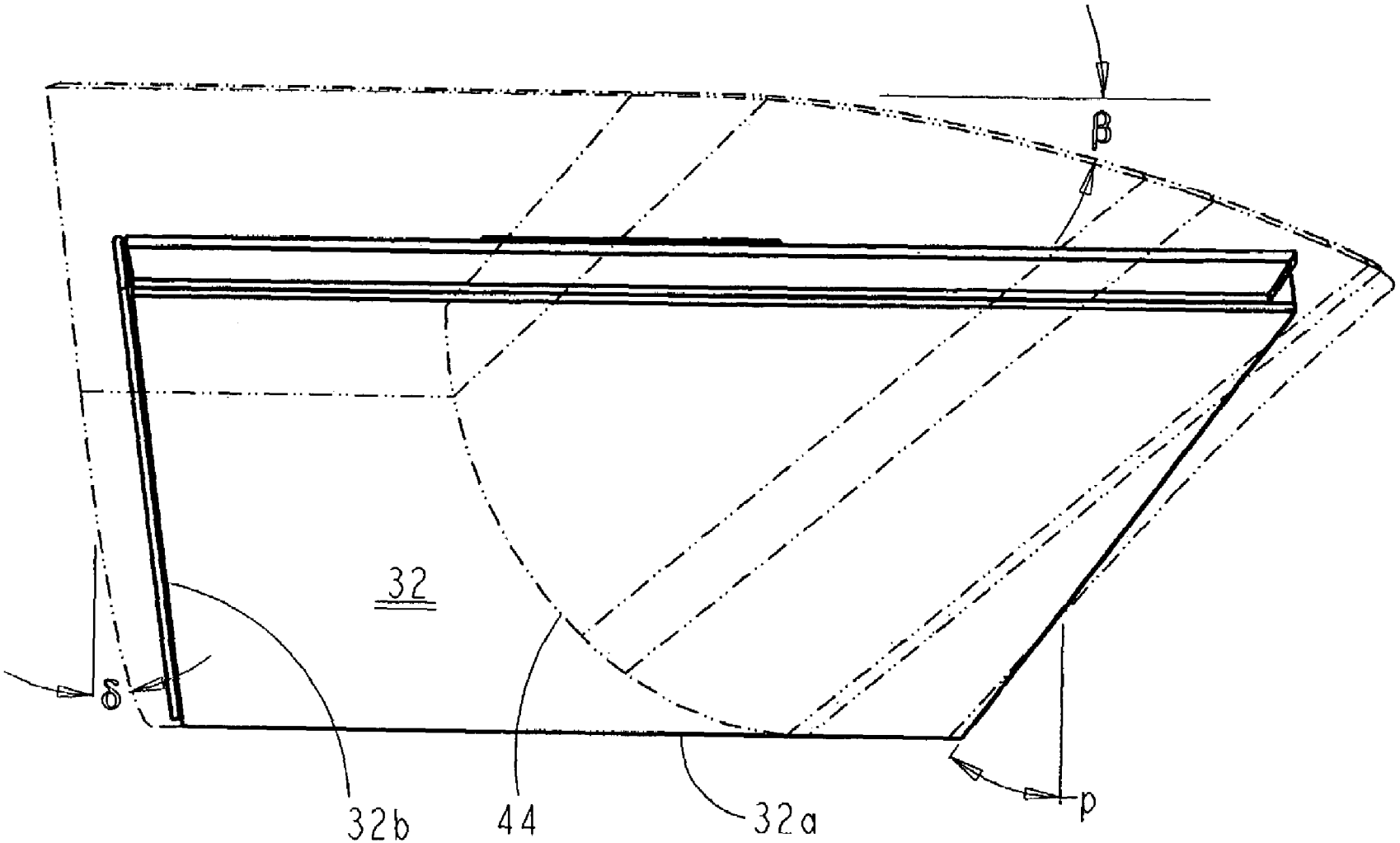
FIG. 9 is, in bottom view, the bucket of FIG. 4 showing the top plate in solid outline and the remainder of the bucket in dotted outline.

As seen in FIG. 5, right-hand curved edge 46 also forms angle β, when viewed in plan view, with a line extending linearly from front edge **40*a* of bottom wall 40. Also, when viewed in left side elevation, as seen in FIG. 6, curved edge 46 forms an angle π' with the horizontal which angle varies because of the slight curvature in that view of curved edge 46, but which generally is twenty-three degrees. Similarly, front edge 36*a* of left side 36 forms an angle π" of generally eighteen degrees with the horizontal. The forward-most edge of left side 36 may also include a cut back or notch 36***b* which then drops the remainder of the forward-most edge 36*c* closer to the horizontal.

What follows are dimensions representative of a preferred embodiment which, although not intending to be limiting, will provide to those skilled in the art guidelines representative of the scaleable proportions of the various parts of the bucket. Thus as seen in FIG. 6, dimension a, which is the curved profile when viewed in left side elevation of the back and bottom of the bucket, may be fifty inches. The depth of the bucket illustrated as dimension b in FIG. 6 may be twenty-nine inches. The front edge dimensions of left side wall 36 may be broken down into three dimensions c, d and e, respectively fourteen inches, five inches and nine inches. Referring to FIG. 4, and commencing with the front left hand lowermost corner of the bucket opening 30*a*, dimension f, which extends along the front edge of bottom wall 40, may be fifty-five inches. Dimension g, the length of lower end 46*a* of curved edge 46, may be nine inches. An adjacent segment of curved edge 46 indicated by dimension h, may be nineteen inches. The adjacent segment of curved edge 46 indicated by dimension i may be twenty-nine inches. Finally, the adjacent segment of curved edge 46 including upper end 46*b*, indicated by dimension j, may be fourteen inches. The total length of top wall 42, including the right edge protrusion 46*c*, as indicated by dimension k may be seventy-four inches.

Inside the bucket itself, dimension 1 may be forty-two inches (the dimension between left wall 36 left edge 44 along top wall 32), dimension m may be forty inches (the length of left edge 44 measured so as to follow the curvature of the rear of the bucket), angle Δ may be in the order of twenty-seven degrees (although other angles formed between axes C and D, for example within the range of twenty to thirty-five degrees depending on the available range of angular rotation about axis F, fall within the scope of the present invention), dimension n seen in FIG. 6 may be thirty-four and one half inches (the height of the open front face of the bucket), dimension o may be thirty-nine inches (the length of seam 34*a* between rear wall 34 and lower wall 38 as that seam extends between the intersection with left wall 36 and left edge 44), and dimension p may be twenty-nine inches (the length of seam 38*a* between lower wall 38 and bottom wall 40 as it extends from the intersection with left wall 36 and left edge 44). Within the curved end portion of the bucket 30, the length dimensions extending from left edge 44 to curved edge 46 are illustrated as adjacent dimension lines q which may be twenty-four and one half inches, r which may be thirty-three and one half inches, and s which may be forty inches. Dimension t indicates the length of bucket 30 at its greatest when viewed in front elevation. Dimension t may be seventy-five inches. Angle α may be approximately twenty-seven degrees, and angle θ may be about five degrees. Angle p may be thirty-five degrees.

Figure 10:
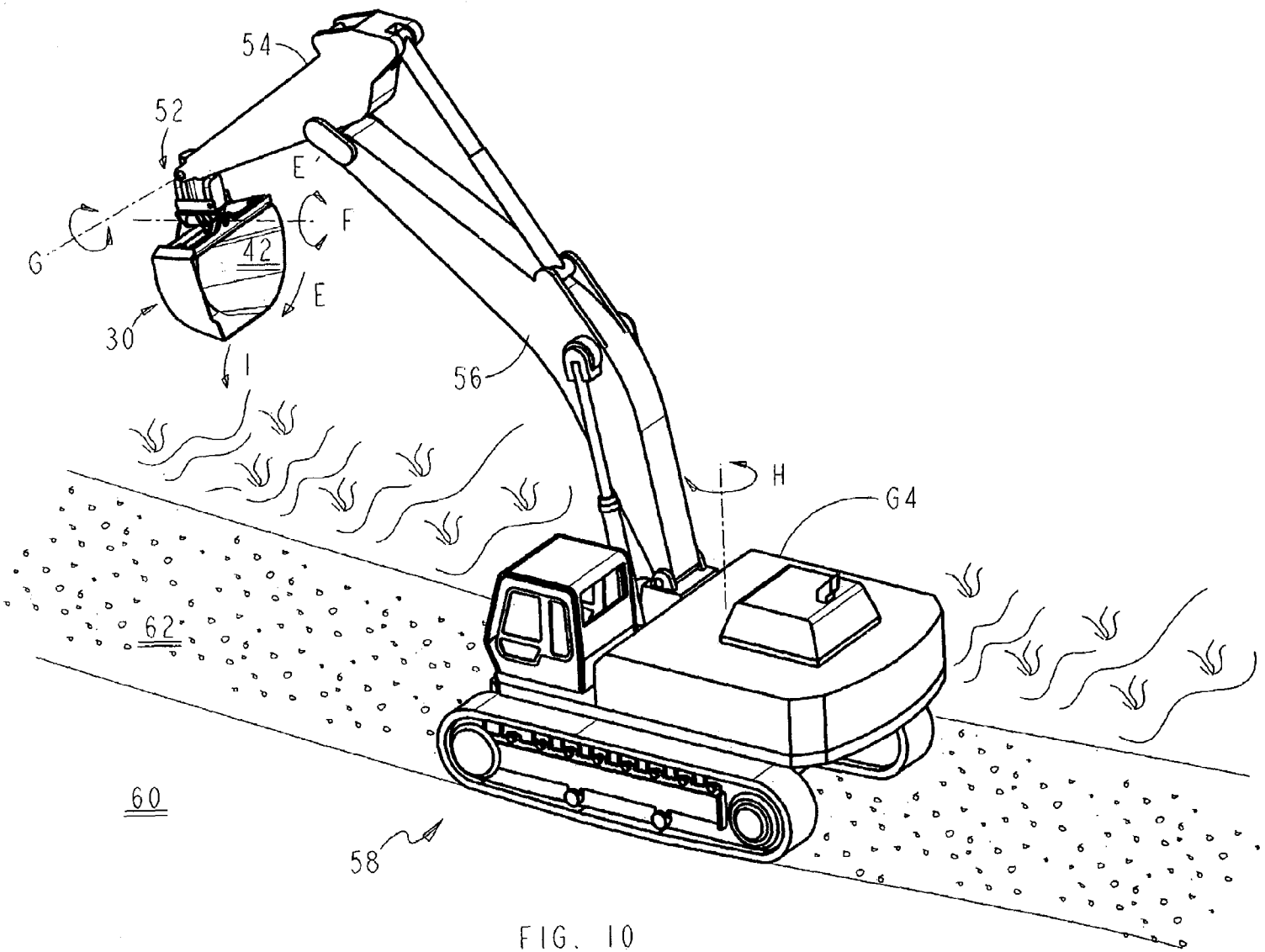
FIG. 10 is, in perspective view, the bucket of FIG. 4 mounted on an excavator.
Figure 11:
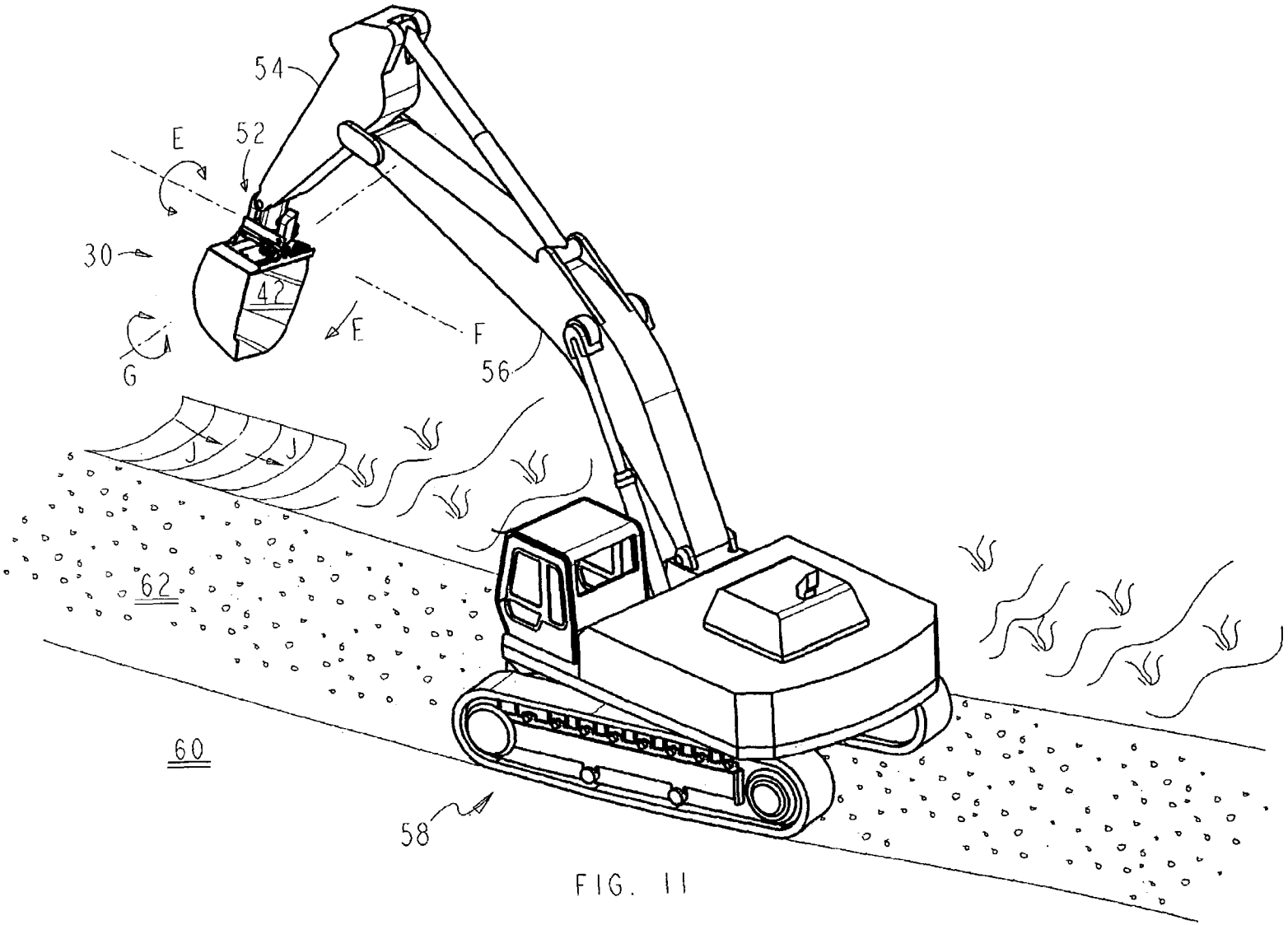
FIG. 11 is the view of FIG. 10, with the bucket lowered and ready to be dragged through the ground along a roadway shoulder so as to excavate a ditch.
Figure 12:
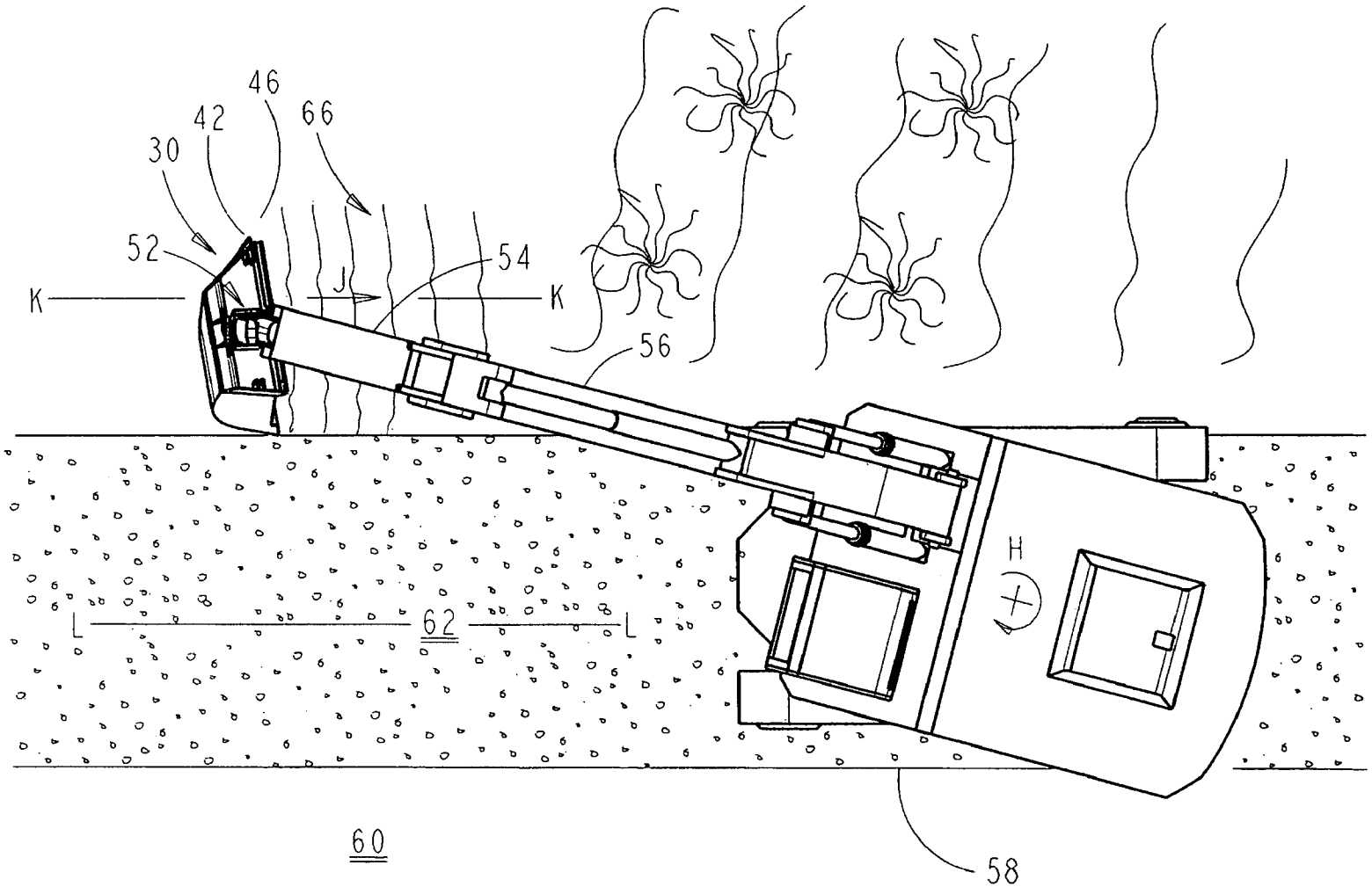
FIG. 12 is the excavator and bucket of FIG. 11, in plan view.
Figure 13:
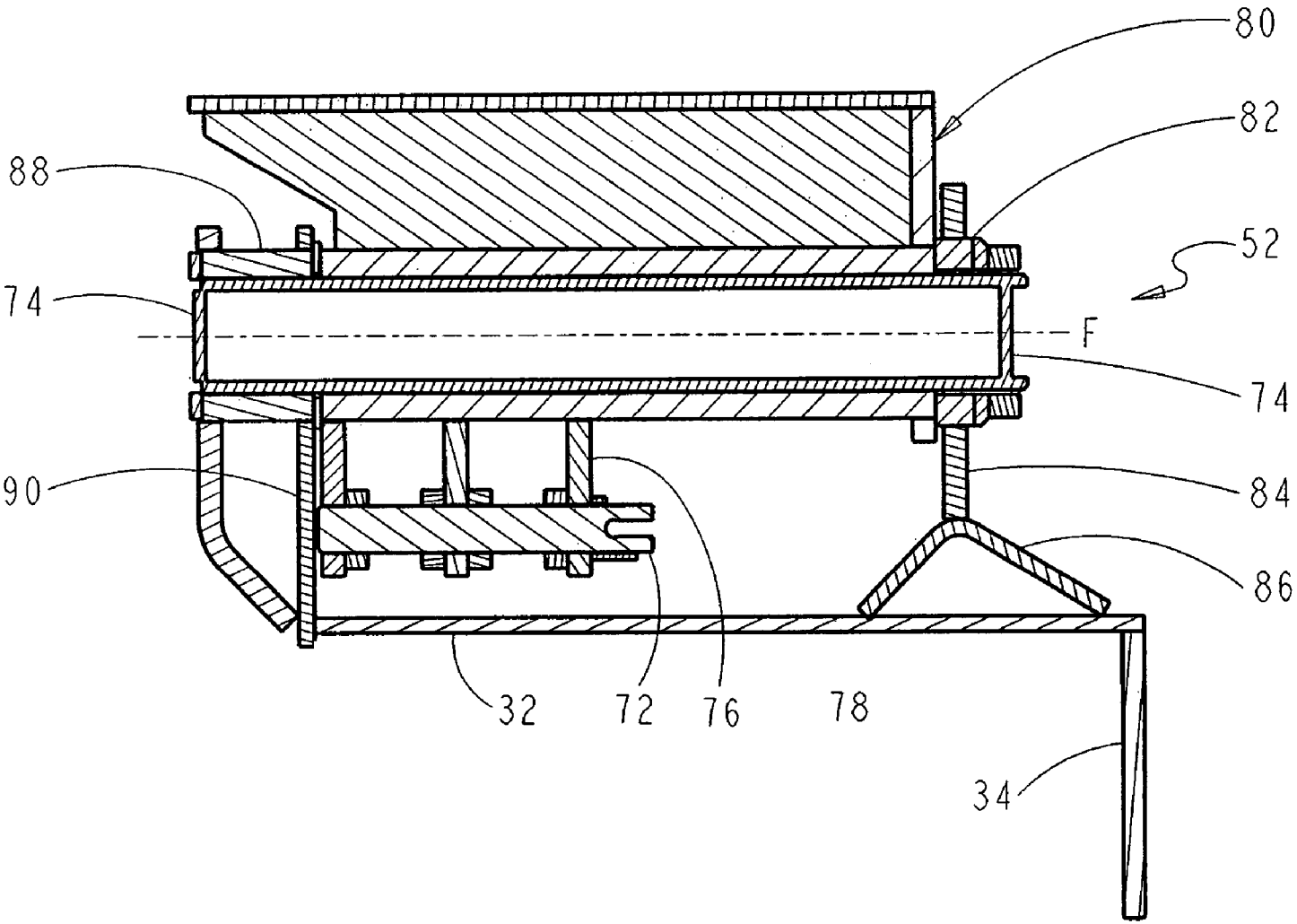
FIG. 13 is a cross-sectional view along line 13—13 in FIG. 4.
Figure 14:
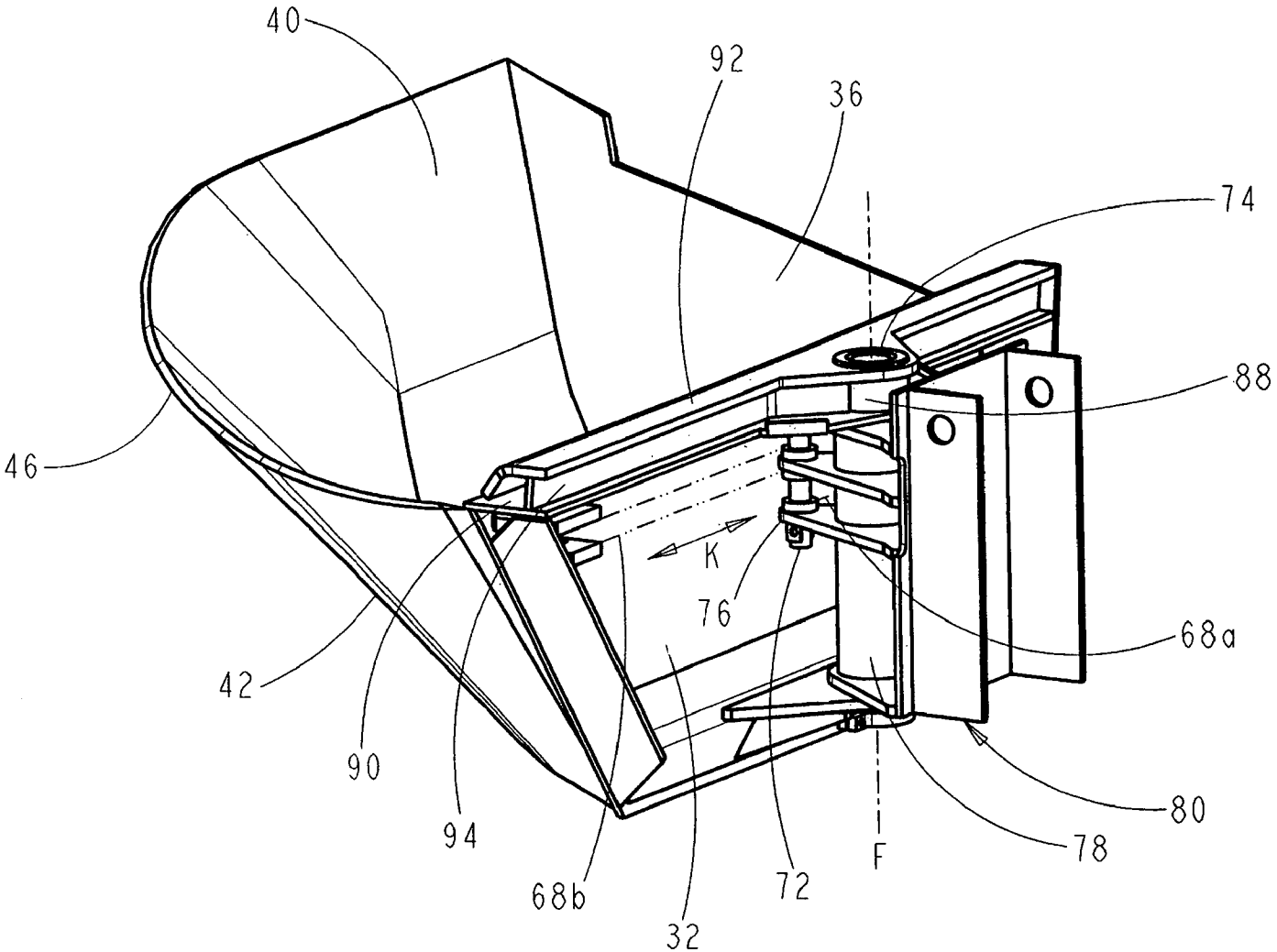
FIG. 14 is a front perspective view of the bucket of FIG. 4.

As seen in FIGS. 10–12, in operation, the driver of the excavator parks the excavator so that base 58 is parallel to roadway 60. The upper rotatable section 64 of the excavator is then rotated in direction H so as to rotate the boom, stick and bucket relative to the base by an angular offset sufficient to position bucket 30 vertically over the proposed ditch 66. With bucket 30 generally vertically over proposed ditch 66, the bucket may be rotated in direction E, that is direction E' about pivot axis F, so as to lower curved end wall 42 below side wall 36. Bucket 30 is then lowered in direction I so as to bring curved-edge 46 and curved end wall 42 into engagement with the earth bordering shoulder 62. Curved end wall 42 is then dragged in a single pass in direction J so as to form proposed ditch 66. Once a volume of earth is scooped into bucket 30 over curved edge 46, the bucket is rotated about axis of rotation G so as to scoop the earth upwardly, and bucket 30 raised. As bucket 30 is raised, rotatable section 64 of the excavator may be rotated so as to position the bucket over a dump truck (not shown) parked on the roadway 60 so that the bucket may be unloaded by dropping its load of earth into the dump truck. With the bucket now empty, the cycle may be repeated to lengthen proposed ditch 66 along shoulder 62. As the length of proposed ditch 66 extends towards the excavator, the excavator is intermittently moved along shoulder 62 so that proposed ditch 66 may be dug in the span between bucket 30, when at the most fully extended articulated position of boom 56 and stick 54, and the closest distance of bucket 30 comes to the excavator cab when boom 56 and stick 54 are in their fully retracted position.

Because of the angular offset of boom 56, stick 54, and bucket 30 relative to base 58 of the excavator, the profile of curved end wall 42 including the profile of curved edge 46 as it is described above and illustrated herein, is such that, with bucket 30 rotated about axis F in direction E, the curved profile provides for a smoothly contoured ditch with no upper edge undercut on the embankment side of the ditch, normally all in a single pass of the bucket. The offset angle Δ between longitudinal axes C and D takes into account the physical limitations of how far bucket 30 may be rotated in direction E about axis F using conventional pivot couplers 52 referred to as tilting mechanism bucket or a "Wrist-A-Twist"™. The cut back angle β of curved edge 46 relative to the forward edge 40*a* of bottom plate 40, in conjunction with the offset angular orientation of the bucket, stick and boom relative to the base 58 of the excavator, assists in curved end wall 42 biting downwardly into the ground as the bucket is dragged in direction J. This assists the curved end of the bucket staying in the ground rather than having to solely rely on the downward force applied by the excavator arm on the bucket. Similarly, the scoop angle p and the cut back angle π' assist in curved edge 46 and curved end wall 42 aggressively biting into the earth and urging the bucket to stay submerged in the earth as the bucket is translated in direction J. Thus up to a twelve foot offset is obtained between ditch line K (coincident with the buckets translation in direction J) and the longitudinal axis L of the excavator running parallel thereto. The shape of the curved end of the bucket (that is the cone), including the thirty-five degree angle of the radiused corner of the curved end, creates an offset effect whereby, once submerged in the soil, the bucket is urged to translate along the offset distance of ditch line K.

The pivoting of bucket 30 about pivot axis F is accomplished in one embodiment, not intended to be limiting, by the simultaneous actuation of hydraulic cylinders 68*a* and 68*b* (shown in dotted outline) mounted between ears 70*a* and 70*b* at their distal ends respectively, and at their inwardly opposed facing ends to shaft 72. Actuation of hydraulic cylinders 68*a* and 68*b* drives shaft 72 in direction K relative to top wall 32 of the bucket thereby rotating bucket 30 about axis F and tubular shaft 74. Shaft 72 is rotatably mounted to flanges 76, themselves rigidly mounted to tubular sleeve 78 and upper mounting bracket 80. Sleeve 78 is mounted to tubular shaft 74. Mounting bracket 80 is mounted to the distal end of stick 54 by means of a conventional excavator bucket coupler which provides for rotation of bucket 30 and coupler 52 about axis G. The rearmost end of tubular shaft 74 is rotatably mounted within a bearing housing 82, itself rigidly mounted onto top wall 32 by rigid plate 84 and its corresponding base 86. The forward-most end of tubular shaft 74 is rotatably mounted in collar 88, itself rigidly mounted to front plate 90. Rigid nose plate 92 is rigidly mounted so as to extend between collar 88, a forwardly extending rigid support flange 94, and front plate 90.

Figure 15:
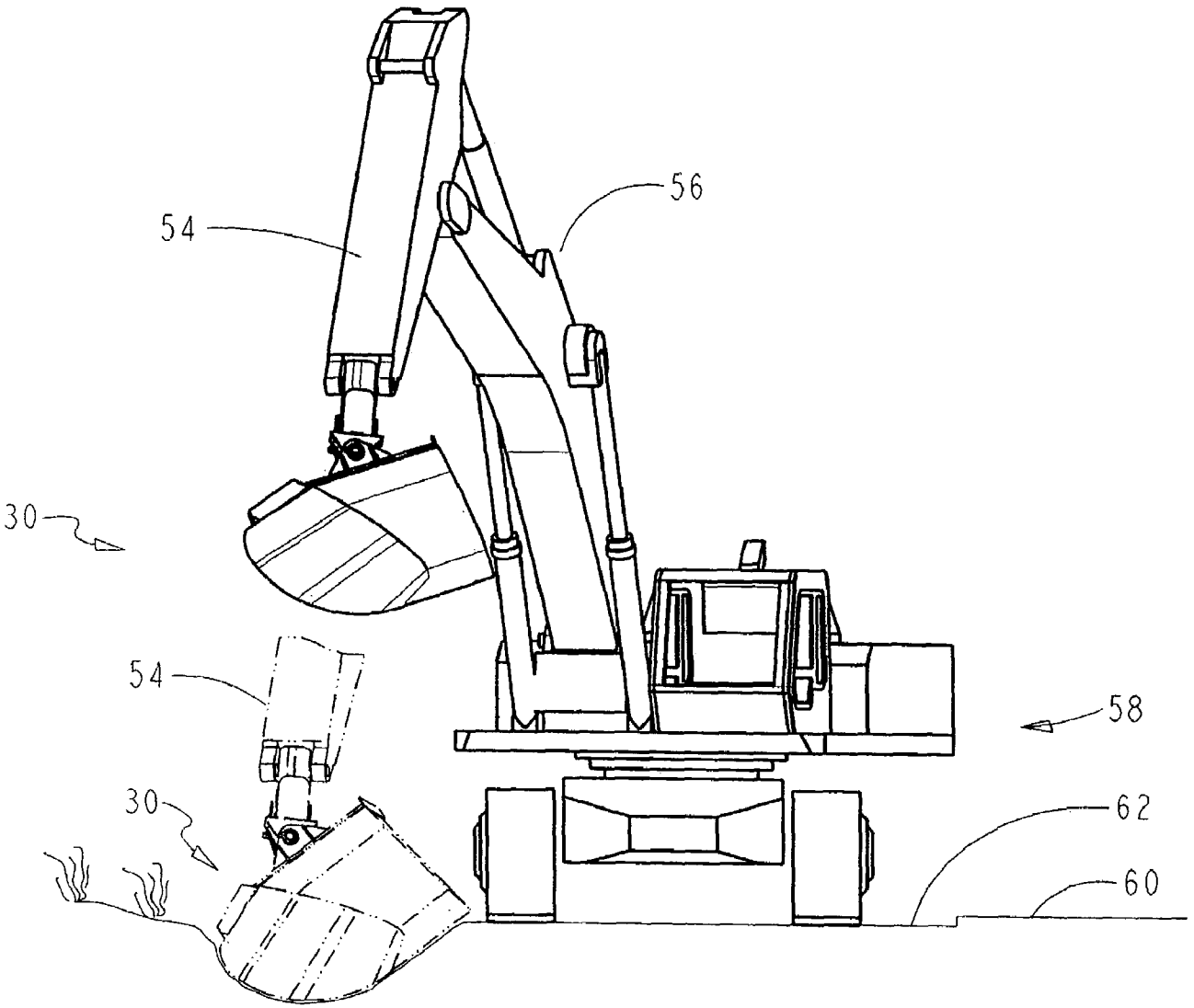
FIG. 15 is, in front elevation view, the bucket of FIG. 4 mounted on an excavator and oriented for excavation during forward translation of the excavator.

As seen in FIG. 15, in a method for use in lighter soil, the excavator excavates a ditch as it drives forwardly. This is accomplished by orienting the bucket forwardly relative to the excavator, again with the rounded end of the bucket disposed downwardly to engage the soil. The excavator then drives ahead, until the bucket is full and windows start to form on either side of the bucket.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A one-pass bucket (30) for use on an end of an actuable arm on a mechanical ditch digging apparatus for digging a ditch parallel to a roadway, the bucket comprising a top wall (32); a bottom wall (40); a rear wall (34,38) integral with said bottom wall, said rear wall and said bottom wall defining a curve (a') extending downwardly and forwardly from a rear edge (32*a*) of said top wall to an open front end of said bucket; a first side wall (36) extending forwardly from a first end (38*b*) of said rear wall and interconnecting a first end of said top wall (32*b*) and a corresponding first end (40*a*) of said bottom wall; and, a curved end wall (42) opposite said first side wall (36), said curved end wall (42) extending forwardly from an opposite second end (38*c*) of said rear wall, opposite said first end of said rear wall, and interconnecting an opposite second end (32*c*) of said top wall, opposite said first end of said top wall, and an opposite second end (40*b*) of said bottom wall, opposite said first end of said bottom wall, said curved end wall having opposite curved bottom (46*a*) and top (46*b*) ends, said first side wall diverging forwardly (angle δ) from said rear wall; said top wall, said bottom wall and said first side wall having forward edges (32*d*, 40*a*, 36*b*) defining said open front end (30*a*) of said bucket for receiving earth; said first side wall defining an acutely-angular corner (angle θ') with said first end of said bottom wall, whereby the bucket may be dragged through the earth with the acutely-angular corner (angle θ') extending downwardly to break-up particularly densely compacted soil and rock material, said curved end wall defining a convexity (42*a*) extending tangentially from said second end (40*b*) of said bottom wall, said convexity (42*a*) tapering rearwardly toward said rear wall (34, 38), and when viewed in front elevation said curved end wall (42) extending convexly from the bottom wall (40) to said top end (46*b*) at a forward edge (46) thereof, and extending substantially diagonally upwardly therefrom at a rearward edge (44) so that the forward edge (46) of the curved end wall (42) curves upwardly towards a plane of the top wall (32) so as to intersect it non-tangentially, and the rearward edge (44) extends diagonally (angle α) to intersect said plane of the top wall (32), whereby a round bottom ditch is formed by rotating said curved end wall (42) downwardly relative to the acutely angled corner (angle θ') and dragging the curved end wall (42) through the soil longitudinally of the ditch, and parallel to the roadway, wherein, when said front opening of said bucket is viewed in front elevation (FIG. 4), said bottom wall (40), said rear wall (34, 38), said first side wall (36), and said first end of said top wall (32*b*) define a first portion of said bucket having a first longitudinal axis (C) substantially parallel to and substantially equi-distant between said top and bottom walls; and, said curved end wall (42) and said second end (32*c*) of said top wall define a second portion of said bucket having a second longitudinal axis (D), and wherein said first and second longitudinal axes (C, D) intersect substantially on said rearward edge (44) of said curved end wall (42), and wherein said second longitudinal axis (D) diverges downwardly (angle Δ) from colinearity with said first longitudinal axis (C), and wherein said curved bottom end (46*a*) of said curved end wall (42) intersects said bottom wall (40) approximately half-way (ratio f/k) along a length (k) corresponding to approximately the length of said top wall (32), and wherein, when said bucket is viewed from a plan view (FIG. 5), said curved end wall (42) diverges forwardly from said rear wall (34, 38) at an angle (angle p) greater than the angle (angle δ) at which said first side wall (36) diverges forwardly from said rear wall (34, 38), and wherein, when said bucket is viewed in plan view, said forward edges of said bottom wall (40) and said curved bottom end (46*a*) of said curved end wall (42) extend forwardly (distance u) of said forward edge (32*d*) of said top wall (32), and said forward edge (46) of said curved end wall (42) slopes rearwardly (angle β), and downwardly (angle π') when viewed in side elevation view (FIG. 6), from intersecting said forward edge of said bottom wall (40), at said curved bottom end (46*a*), to said top end (46*b*) so that said forward edge of said top end (46*b*) curved end wall (42) cuts back and down to intersect said forward edge of said top wall (32), and wherein said curved end wall (42), including a longitudinal outermost tip (46') of said curved end wall (42), extends longitudinally (collinear with axis C) beyond a corresponding end (32*c*) of said top wall (32).

2. The bucket of claim 1 wherein said curved end wall curves upwardly towards said plane of said top wall so as to intersect it generally orthogonally.

3. The bucket of claim 1 wherein said curved end wall 42 is formed of a plurality of substantially planar segments so as to form a seamed curved wall having seams at boundaries between said segments.

4. The bucket of claim 3 wherein said plurality of substantially planar segments includes at least six said segments.

5. The bucket of claim 1 wherein said second portion of said bucket forms a shovel or scoop having said second longitudinal axis D declined relative to said first portion.

6. The bucket of claim 5 wherein said longitudinal axis D is diverging relative to said first portion.

7. The bucket of claim 1 further comprising a pivotable coupler mounted to said top wall for pivotally mounting said top wall to the actuable arm of the ditch digging apparatus so that said curved end wall is rotatable downwardly relative to the actuable arm while simultaneously said first portion is rotated upwardly.

8. The bucket of claim 1 wherein said second portion is generally conical.

* * * * *